US010166663B1

(12) United States Patent
Christensen

(10) Patent No.: US 10,166,663 B1
(45) Date of Patent: Jan. 1, 2019

(54) SELF-FLEXING SOCKET AND RELATED TOOLS AND TOOL KIT AND METHODS OF USE

(71) Applicant: AGA Tools & Products, Inc., Escondido, CA (US)

(72) Inventor: Hans Martin Christensen, Escondido, CA (US)

(73) Assignee: AGA Tools & Products, Inc., Escondido, CA (US)

( * ) Notice: Subject to any disclaimer, the term of this patent is extended or adjusted under 35 U.S.C. 154(b) by 23 days.

(21) Appl. No.: 15/233,060

(22) Filed: Aug. 10, 2016

Related U.S. Application Data

(60) Provisional application No. 62/205,468, filed on Aug. 14, 2015.

(51) Int. Cl.
*B25B 27/00* (2006.01)
*B25B 13/46* (2006.01)
*F02M 61/16* (2006.01)

(52) U.S. Cl.
CPC ..... *B25B 27/0035* (2013.01); *B25B 13/46* (2013.01); *B25B 27/0028* (2013.01); *F02M 61/168* (2013.01)

(58) Field of Classification Search
CPC ... B25B 13/46; B25B 13/481; B25B 23/0007; B25B 23/0014; B25B 23/0028; Y10T 403/32081
See application file for complete search history.

(56) References Cited

U.S. PATENT DOCUMENTS 1,324,898 A * 12/1919 Hopcraft ..... C07D 403/14 254/1
3,522,713 A * 8/1970 Hayes ..... B25B 23/0014 464/119
3,897,703 A * 8/1975 Phipps ..... B25B 13/06 81/177.75
3,996,821 A 12/1976 Murray
4,065,941 A * 1/1978 Aoki ..... F16D 3/207 464/115
4,807,499 A * 2/1989 Martinez ..... B25B 13/06 411/392

(Continued)

OTHER PUBLICATIONS

YouTube. AGA Direct Fuel Injection. https://www.youtube.com/watch?v=H_DEetgHzKg&t=4s. Published May 15, 2015.*

*Primary Examiner* — Tyrone V Hall, Jr.
(74) *Attorney, Agent, or Firm* — Lodestone Legal Group; Jeromye V. Sartain

(57) ABSTRACT

A self-flexing socket tool comprising an upper socket linkage, an intermediate connecting linkage, and a lower socket linkage coupled substantially in series and having two pivot points therebetween, and a spring member fixedly coupled to the lower socket linkage and slidably coupled to the upper socket linkage, wherein the spring member biases the upper socket, intermediate connecting, and lower socket linkages into a substantially aligned first operable configuration, and further wherein the spring member may be selectively actuated to shift the upper socket, intermediate connecting, and lower socket linkages into a substantially curved second operable configuration. Also provided are a tool kit having the self-flexing socket tool and/or one or more other tools and methods of use thereof.

14 Claims, 9 Drawing Sheets

(56) References Cited

U.S. PATENT DOCUMENTS

| | | | | |
|---|---|---|---|---|
| 4,913,007 | A | 4/1990 | Reynolds | |
| 5,199,335 | A | 4/1993 | Arnold et al. | |
| 5,455,997 | A * | 10/1995 | Nasiell | B25B 13/481 29/456 |
| 5,458,028 | A * | 10/1995 | Cleveland, III | B25B 23/0014 464/119 |
| 5,851,208 | A * | 12/1998 | Trott | A61B 17/32002 606/80 |
| 6,267,681 | B1 * | 7/2001 | Cleveland, III | B25B 23/0014 464/106 |
| 6,390,927 | B1 * | 5/2002 | Cleveland, III | B25B 23/0014 403/321 |
| 7,328,634 | B1 | 2/2008 | Greenberg et al. | |
| 8,495,934 | B2 * | 7/2013 | Schneider | B25B 23/0021 81/177.6 |
| 2010/0294089 | A1 * | 11/2010 | Lai | B25B 23/0021 81/177.6 |
| 2011/0152867 | A1 * | 6/2011 | Petrzelka | A61B 17/1631 606/80 |
| 2011/0197719 | A1 * | 8/2011 | Neitzell | B25B 13/481 81/177.75 |

* cited by examiner

SELF-FLEXING SOCKET AND RELATED TOOLS AND TOOL KIT AND METHODS OF USE

RELATED APPLICATIONS

This non-provisional patent application claims priority pursuant to 35 U.S.C. § 119(e) to and is entitled to the filing date of U.S. Provisional Patent Application Ser. No. 62/205,468 filed Aug. 14, 2015, and entitled "Self-Flexing Socket and Related Tools and Tool Kit and Methods of Use." The contents of the aforementioned application is incorporated herein by reference.

BACKGROUND

The subject of this patent application relates generally to tools and tool kits and methods of use, and more particularly to self-flexing socket tools, individually and as included in a tool kit, configured for loosening or tightening hard to reach nuts, such as while replacing fuel injectors in an engine.

Applicant hereby incorporates herein by reference any and all patents and published patent applications cited or referred to in this application.

By way of background, typically, to replace the fuel injectors in many engine and vehicle makes presents challenges related to accessing some of the fuel line and high pressure line connections, particularly the lower connections at the high pressure injector rail or fuel rail. Obstructions such as the fire wall and the steering shaft can render it very difficult to access the lower fuel and high pressure line nuts or connections using the typical solid and straight crow's foot sockets, such as in the nominal 14 mm and 17 mm sizes. As a result, disassembly of other parts of the engine, such as surrounding components that are otherwise unrelated to the fuel injection system, may be necessary, adding time, cost, and complexity to the job. In rare cases, removal of the entire engine from the vehicle in order to access the fuel injectors may be necessary, making the repair job extremely labor-intensive as compared to being able to somehow remove and replace the injectors with the engine and surrounding structure in place.

Aspects of the present invention fulfill these needs and provide further related advantages as described in the following summary.

SUMMARY

Aspects of the present invention teach certain benefits in construction and use which give rise to the exemplary advantages described below.

The present invention solves the problems described above by providing self-flexing socket tools, individually and as included in a tool kit, configured for loosening or tightening hard to reach nuts, such as while replacing fuel injectors in an engine. In at least one embodiment, the self-flexing socket tool comprises an upper socket linkage, an intermediate connecting linkage, and a lower socket linkage coupled substantially in series and having two pivot points therebetween, and a spring member fixedly coupled to the lower socket linkage and slidably coupled to the upper socket linkage, wherein the spring member biases the upper socket, intermediate connecting, and lower socket linkages into a substantially aligned first operable configuration, and further wherein the spring member may be selectively actuated to shift the upper socket, intermediate connecting, and lower socket linkages into a substantially curved second operable configuration.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

By way of introduction, and in more detail regarding the problem addressed by the self-flexing socket tool and method of use of the present invention, it is noted that the exemplary context is removal and installation of fuel injectors in automotive direct fuel injection systems, such as when the fuel injector seals are to be replaced. A representative engine is the "N63" engine manufactured by BMW and installed primarily in that automaker's "5 series", "6 series" and "7 series" sedans and "X5" and "X6" vehicles. However, even in this specific exemplary fuel injector context, other engines that include Siemens, Bosch or other brand injectors, such as may be found in Mercedes, Audi, Volkswagen, and Porsche engines and vehicles, may also benefit from the self-flexing socket of the present invention. In the exemplary fuel injector repair context, the illustrated 14 mm and 17 mm self-flexing socket tools are included in a direct fuel injection repair kit along with a number of other unique components. Moreover, still in the automotive context, beyond fuel injector repair jobs, other jobs such as valve cover gasket replacement also require temporary removal of the fuel injectors and so would advantageously employ a self-flexing socket tool according to aspects of the present invention as well. Moreover, it will be appreciated that such a new and novel self-flexing socket tool has application in a nearly infinite number of commercial contexts, essentially wherever a nut or connection is to be accessed and torque applied from a direction other than along the central axis of the nut and the bolt it is threaded on yet without appreciable torque loss. As such, the self-flexing socket tool can be employed in any applicable or appropriate context without departing from the spirit and scope of the invention, such that the exemplary direct fuel injector repair context is to be understood as merely illustrative and non-limiting.

Figure 1:
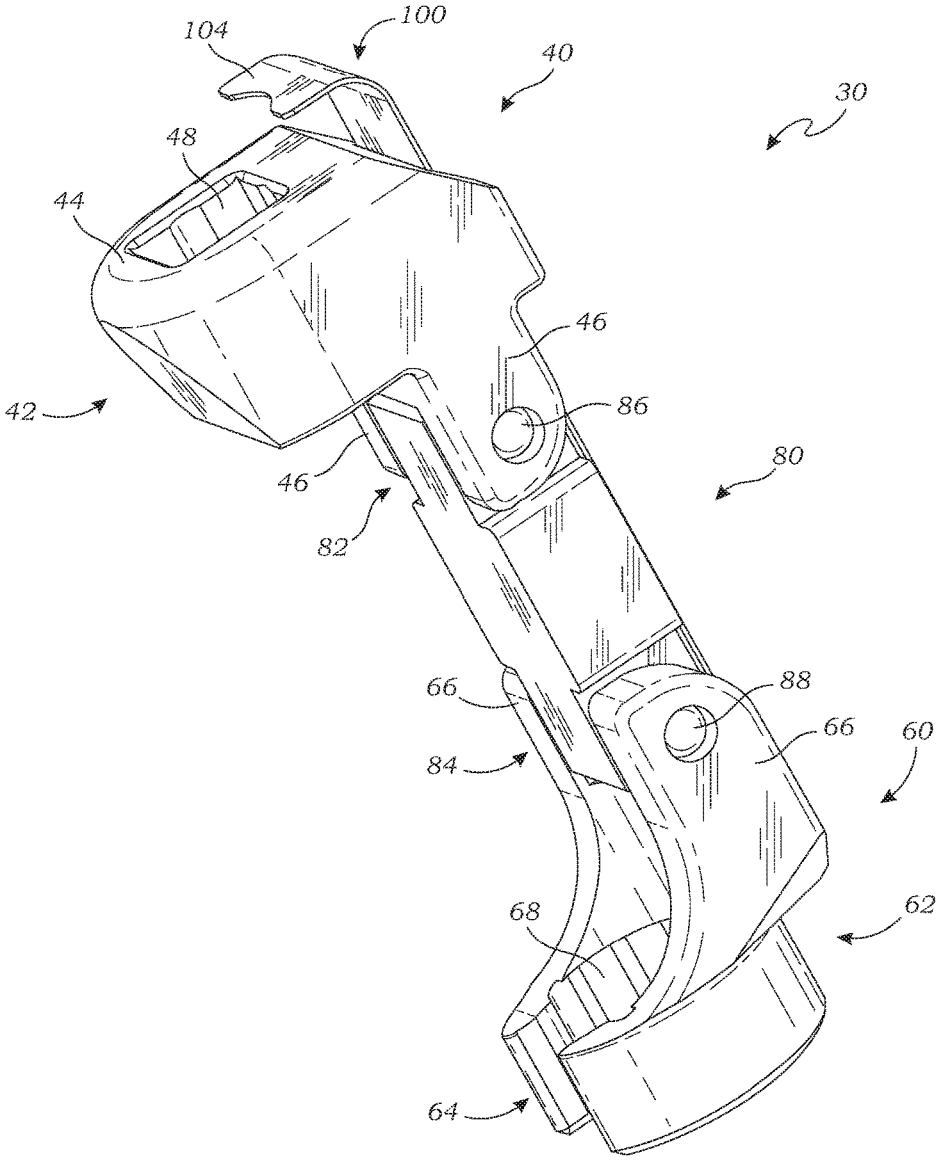
FIG. 1 is a front side perspective view of an exemplary self-flexing socket tool, in accordance with at least one embodiment.
Figure 2:
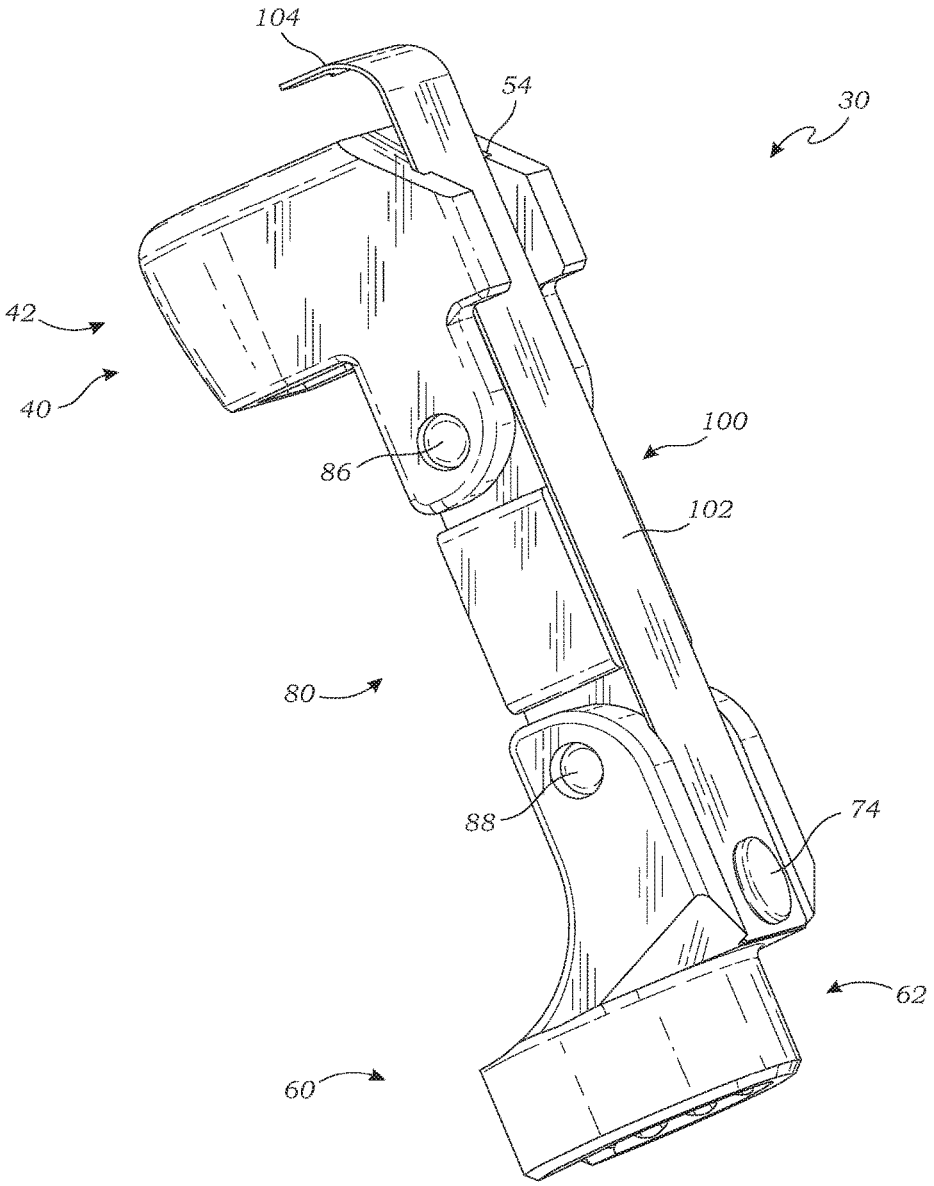
FIG. 2 is a rear side perspective view thereof, in accordance with at least one embodiment.
Figure 3:
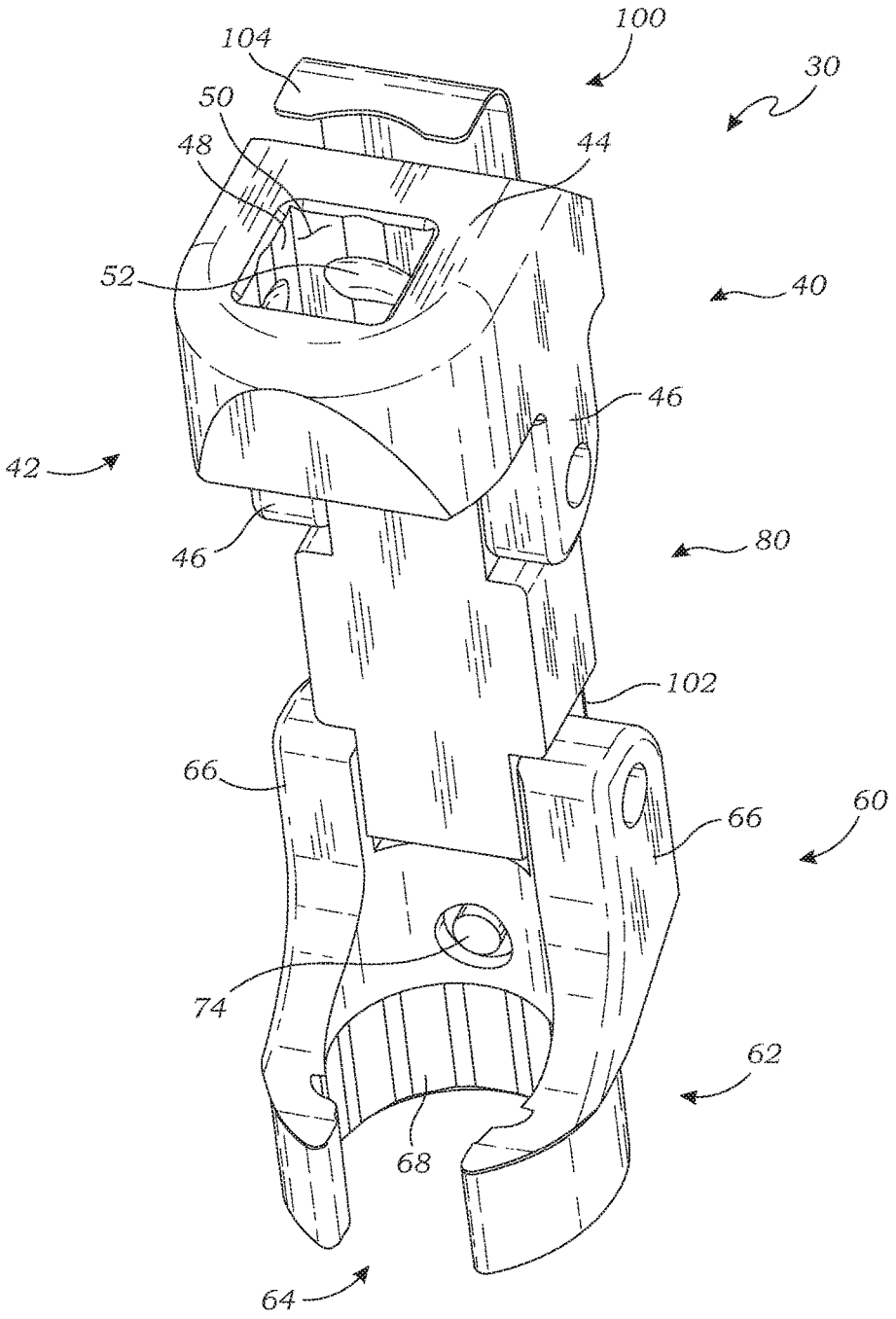
FIG. 3 is a top perspective view thereof, in accordance with at least one embodiment.
Figure 4:
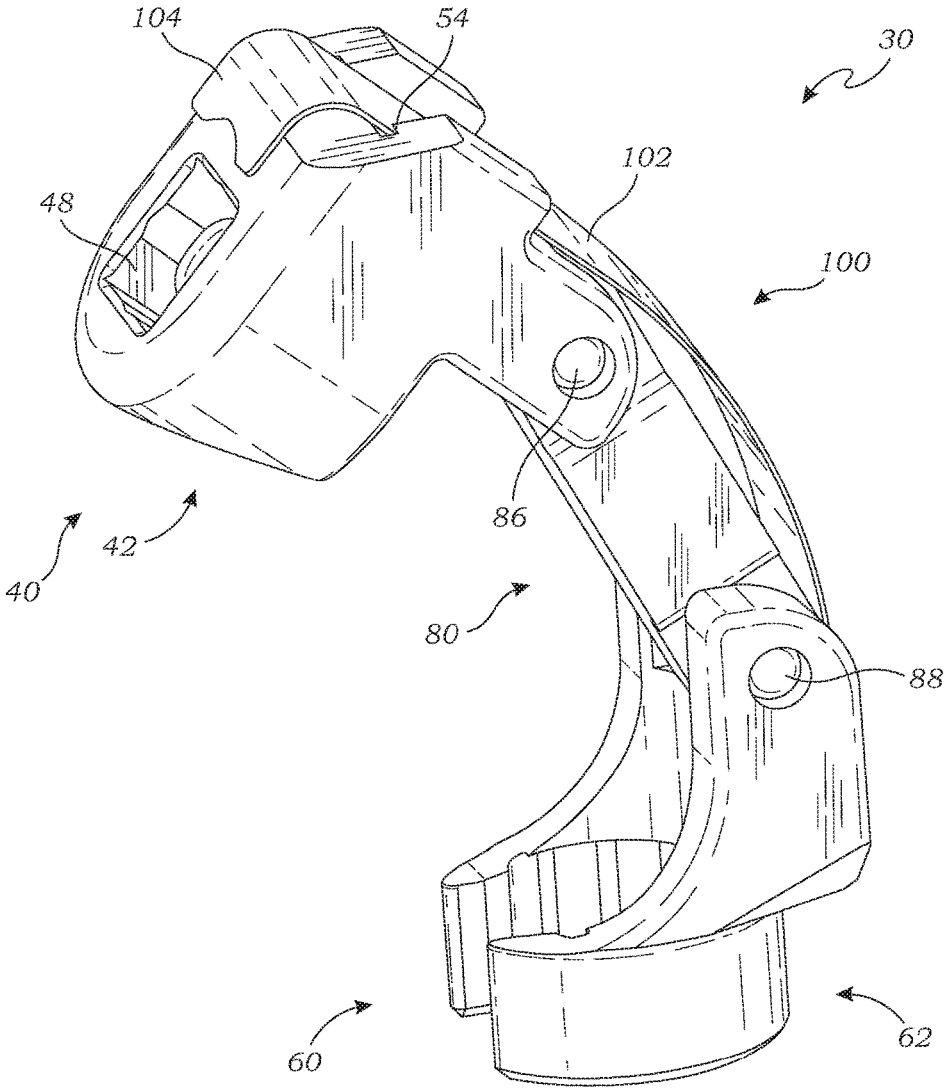
FIG. 4 is a front side perspective view thereof in a flexed configuration, in accordance with at least one embodiment.
Figure 5:
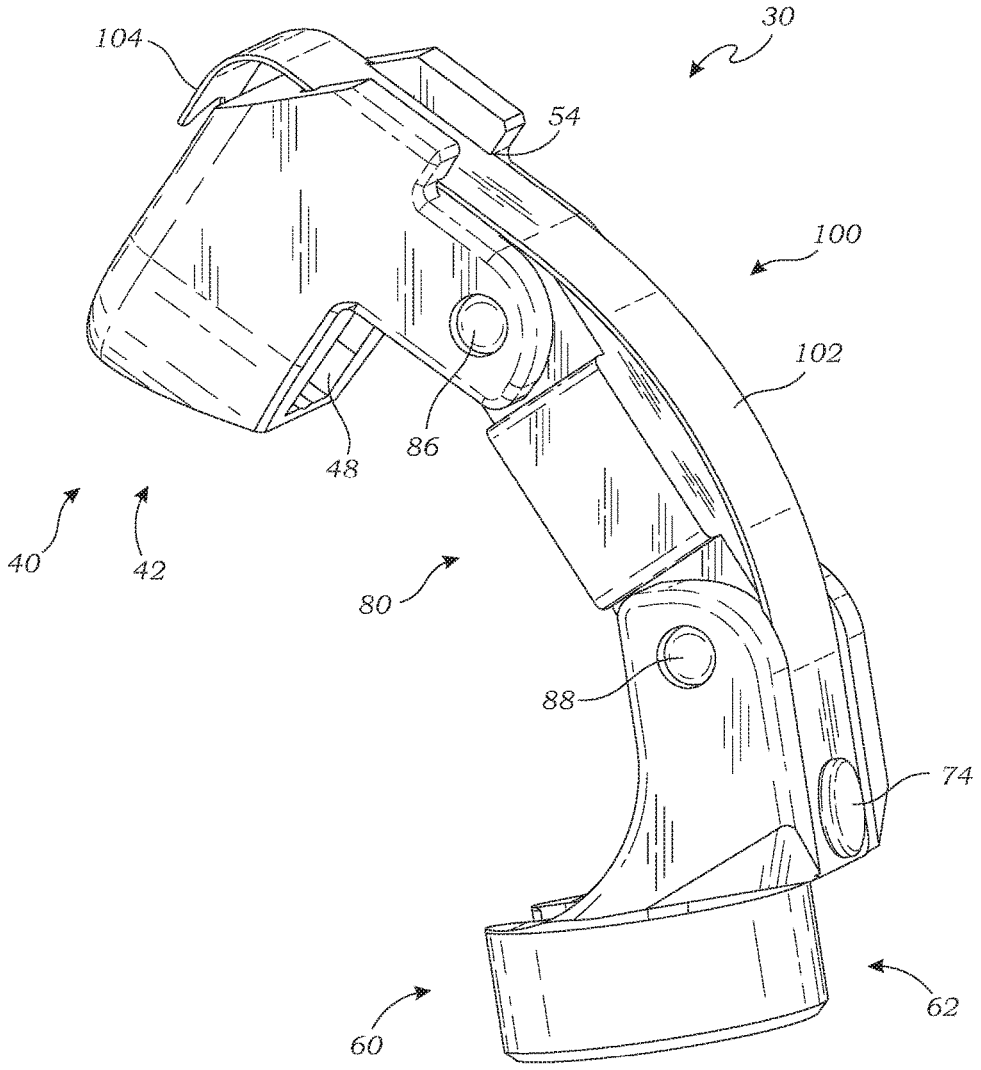
FIG. 5 is a rear side perspective view thereof in a flexed configuration, in accordance with at least one embodiment.

Turning first to FIGS. 1 and 2, there are shown front and rear side perspective views of an exemplary embodiment of a self-flexing socket tool 30 according to aspects of the present invention. The self-flexing socket tool 30 comprises, in the exemplary embodiment, three linkages 40, 60, 80 arranged substantially in series or end-to-end and thus having two pivot points 86, 88 as by being pinned, with a spring member 100 arranged so as to be coupled to two or more of the linkages 40, 60, 80 and bias the linkages 40, 60, 80 into a first operable configuration wherein the linkages are substantially aligned, as shown in FIGS. 1-3, which spring member 100 may be actuated to shift the linkages 40, 60, 80 into a second operable configuration wherein the linkages 40, 60, 80 are no longer aligned and the overall tool 30 is in a substantially curved configuration, as shown in FIGS. 4 and 5 and described in more detail below. As a threshold matter, it will be appreciated that the self-flexing socket tool 30 can take a number of forms or configurations without departing from the spirit and scope of the invention, such that the tool 30 shown and described is to be understood as illustrative of features and aspects of the present invention and non-limiting. It will be further appreciated that a variety of sizes of the self-flexing socket tool 30 are possible, both as to the various linkages 40, 60, 80 and other components of the overall assembly and as to the particular nominal size of the lower socket body 62 of the lower socket linkage 60 or essentially what size nut the tool 30 is configured to engage. Accordingly, while as discussed further below a nominal 14 mm tool 30 is shown, it will be appreciated that the nominal 17 mm tool also included in the exemplary direct fuel injection repair kit 20 (FIG. 7) and any other such self-flexing socket tool 30 would operate on the same principle and essentially involve only scaling of the illustrated 14 mm tool 30. As such, for convenience, just one size of the tool 30 is shown and described. More generally, those skilled in the art will appreciate that the drawings are schematic in nature and are not to be taken literally or to scale in terms of material configurations, sizes, thicknesses, and other attributes of the self-flexing socket tool 30 and its components or features unless specifically set forth herein.

In a bit more detail, and with continued reference to FIGS. 1 and 2, the self-flexing socket tool 30 comprises an upper socket linkage 40, an opposite lower socket linkage 60, and an intermediate connecting linkage 80. The intermediate connecting linkage 80 has the upper and lower socket linkages 40, 60 pivotally connected on opposite ends thereof. The upper socket linkage 40 comprises an upper socket body 42 having a proximal surface 44 and opposite and substantially parallel distally-projecting upper linkage connection tabs 46. In the exemplary embodiment, the upper linkage connection tabs 46 are offset from the central axis of the upper socket linkage 40 rearwardly. Accordingly, an upper socket aperture 48 may be formed in the upper socket body 42 so as to communicate from the proximal surface 44 through the upper socket body 42 without being blocked by the intermediate connecting linkage 80, though it will be appreciated that the aperture 48 need not pass all the way through the upper socket body 42. As illustrated, the upper socket aperture 48 may be substantially square and, as best seen in FIG. 3, may be configured having indents 52 formed on the inner walls 50 of the aperture 48 for purposes of selectively engaging a standard square-drive ratchet R or self-locking socket extension E (FIG. 6) or the like. The distally-projecting upper linkage connection tabs 46 allow for an upper cross-pin 86 to pivotally attach the upper socket linkage 40 onto the intermediate connecting linkage 80 at a proximal or upper end 82 thereof. Similarly, the opposite lower socket linkage 60 is configured having a lower socket body 62 having opposite and substantially parallel proximally-projecting lower linkage connection tabs 66. In the exemplary embodiment, the lower socket body 62 is formed as a crow's foot socket having an opening 64 opposite of the connection tabs 66, the body 62 defining a lower socket aperture 68 in communication with the opening 64 and configured here as a nominal 14 mm socket drive. The proximally-projecting lower linkage connection tabs 66 allow for a lower cross-pin 88 to pivotally attach the lower socket linkage 60 onto the intermediate connecting linkage 80 at a distal or lower end 84 thereof. While in the exemplary embodiment both the upper and lower socket linkages 40, 60 have pairs of connecting tabs 46, 66 that effectively straddle so as to be pinned on the respective upper and lower ends 82, 84 of the intermediate connecting member 80, it will be appreciated that any of the linkages may have only one such mounting tab or the like. Essentially, any selectively pivotable coupling arrangement now known or later developed for assembling the three linkages 40, 60, 80 may be employed without departing from the spirit and scope of the present invention. Where a pair of connecting tabs 46, 66 on each of the upper and lower socket linkages 40, 60 flank the respective upper and lower ends 82, 84 of the intermediate connecting member 80, it will be appreciated as shown that such ends 82, 84 may be formed having reduced thickness to accommodate the connecting tabs 46, 66, which may in some embodiments result in a substantially flush or consistent lateral profile of the socket tool 30. The cross-pins 86, 88 may also be recessed to maintain the flush side walls of the device 30. In the illustrated embodiment, both the upper and lower socket bodies 42, 62 are offset in a common direction relative to the respective upper and lower connection tabs 46, 46 so that the upper and lower apertures 44, 64 are substantially axially aligned when the self-flexing socket tool 30 is in its first or at-rest configuration with the three linkages 40, 60, 80 substantially aligned as by the biasing action of the spring member 100, as shown in FIGS. 1-3. It will be appreciated that a variety of other geometric or kinematic arrangements are possible according to aspects of the present invention without departing from its spirit and scope. Furthermore, while three linkages comprise the self-flexing socket tool 30 of the exemplary embodiment, those skilled in the art will appreciate that other numbers of linkages may be employed as well.

With particular reference to FIG. 2, the spring member 100 is shown as being configured as a substantially flat, flexible or resilient spring body 102 positioned substantially parallel to and adjacent the rear surfaces of the three linkages 40, 60, 80. The upper socket body 42 of the upper socket linkage 40 is formed rearwardly with a substantially lengthwise slotted channel 54 in which the spring body 102 is slidably positioned and trapped or retained. The lower or distal end of the spring body 102 is mounted to the lower socket linkage 60 via a mounting post 74, which as shown may be configured as a rivet, stud, or the like, though it will be appreciated may be any fastening device now known or later developed. At the upper or proximal end of the spring body 102 there is formed a proximal tab 104 that defines a surface on which a substantially axial force can be applied, which when transmitted along the spring body 102 against the fixed or pinned opposite end of the spring body 102 as being mounted on the lower socket linkage 60 through the mounting post 74 serves to selectively flex the spring body 102 and thus the spring member 100 so as to flex the entire self-flexing socket tool 30, more about which is said below in connection with FIGS. 4 and 5. As illustrated, the proximal tab 104 may be formed by simply bending the proximal end of the spring body 102 forwardly toward the upper socket aperture 48, in one embodiment resulting in the tab 104 being substantially parallel to and offset from the proximal surface 44 of the upper socket body 42. Once again, with the spring member 100, and the spring body 102 particularly, biased to a substantially flat or straight "at rest" configuration, it will be appreciated that by effectively securing opposite ends of the spring body 102 to the respective upper and lower socket linkages 40, 80, as by fixing the lower or distal end to the lower socket linkage 60 and by slidably trapping the upper or proximal end of the spring body 102 relative to the upper socket linkage 40, the spring member 100 thereby biases the self-flexing socket tool 30, and specifically the pivotable assembly of the three linkages 40, 60, 80, flat or straight as well, again, as shown in FIGS. 1-3. As such, those skilled in the art will appreciate that the configuration of the exemplary self-flexing socket tool 30 shown in FIGS. 1-3 defines a first "at rest" operable configuration of the tool 30.

Turning now to FIGS. 4 and 5, there are shown from two different vantage points perspective views of the self-flexing socket tool 30 of FIGS. 1-3 now in a second "flexed" operable configuration. As shown, both the upper socket linkage 40 and the lower socket linkage 60 are flexed or pivoted inwardly toward each other about the respective pivot points or cross-pins 86, 88 relative to the intermediate connecting linkage 80, thereby putting the self-flexing socket tool 30 in a curved or bowed configuration as shown. Specifically, it can be seen that the spring body 102 of the spring member 100 is generally bowed or flexed to substantially correspond to the curvature or pivoted arrangement of the three linkages 40, 60, 80. It will be appreciated that this is so due to the fact that at the lower end the spring body 102 is pinned to the lower socket linkage 60 via the mounting post 74 and at the upper end the spring body 102 is slidably trapped adjacent the upper socket linkage 40 by passing through the slotted channel 54. Specifically, it will be appreciated that such flexing or actuation of the self-flexing socket tool 30 is achieved by pressing on the proximal tab 104 of the spring member 100 to essentially force the spring body 102 to bow or flex since the opposite end is fixed relative to the lower socket linkage 60, thus shifting the tool 30 into the second, "flexed" operable configuration shown, which allows rotation without any torque lost. That is, as described further below, because the linkages 40, 60, 80 of the tool 30 articulate in the same plane in order to flex, or the cross-pins 86, 88 are parallel, rotational force or torque applied to the tool 30 at the upper socket linkage 40, as by engaging the self-flexing socket tool 30, and the upper socket aperture 48 of the upper socket linkage 40 particularly, with a ratcheting tool R (FIG. 6) or the like, translates to substantially the same rotational force or torque applied by the tool 30 at the lower socket linkage 60. It will be appreciated that other positions with greater or lesser degree of flexure are possible, both in the present exemplary embodiment as by varying the amount of force applied to the proximal tab 104 or by involving different geometries, numbers of linkages, or the like to achieve different mechanical or kinematic effects. As such, those skilled in the art will appreciate that the self-flexing socket tool 30 as shown and described herein in connection with FIGS. 1-5 is merely illustrative of features and aspects of the present invention and non-limiting.

Figure 6:
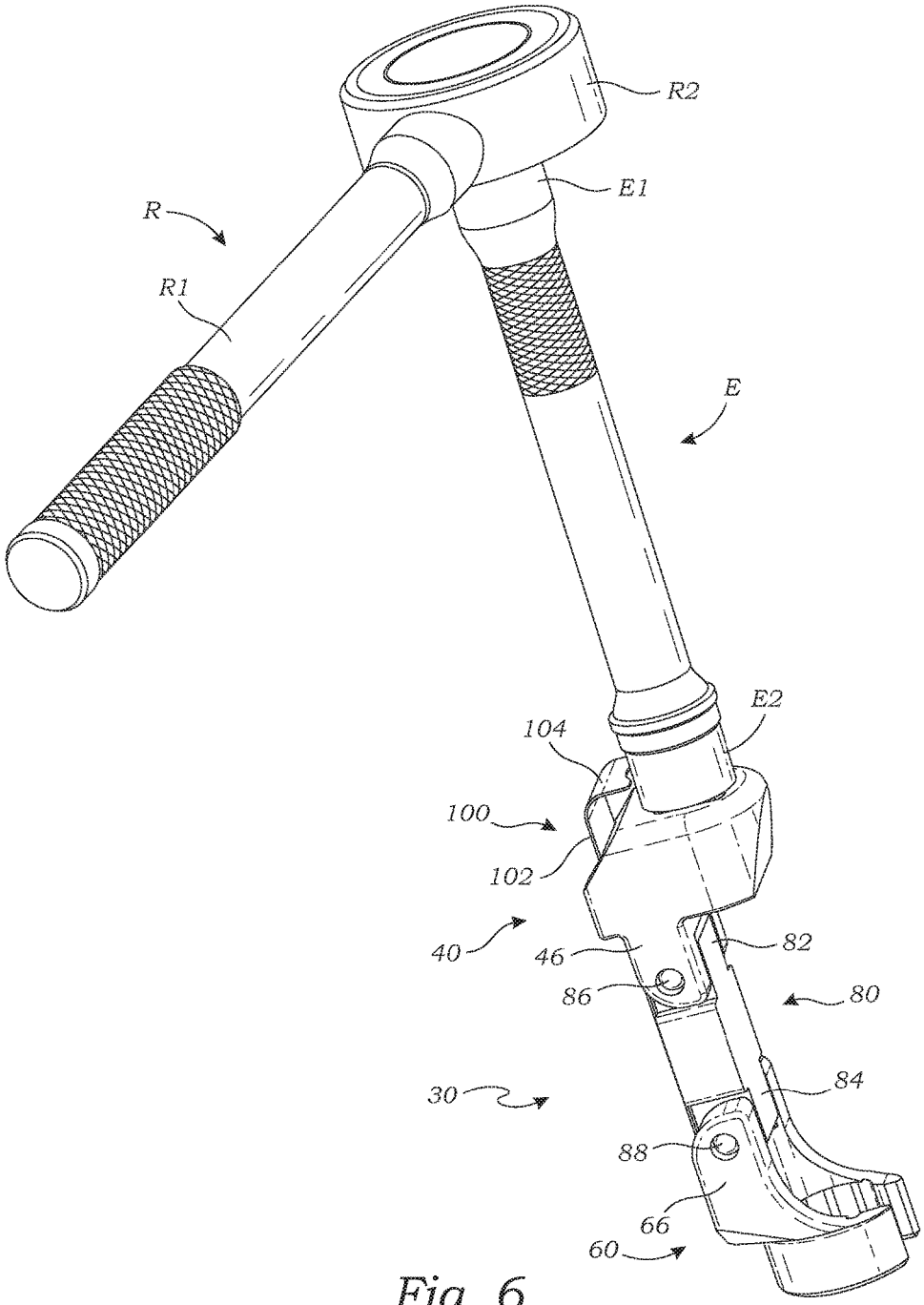
FIG. 6 is a reduced-scale perspective view thereof as in use on a ratcheting wrench with extension, in accordance with at least one embodiment.

Turning to FIG. 6, there is shown a reduced-scale perspective view of the exemplary self-flexing socket tool 30 as in use on a ratcheting wrench R with self-locking extension E. Those skilled in the art will appreciate that a variety of such tools now known or later developed in the art may be employed in connection with a self-flexing socket tool 30 according to aspects of the present invention without departing from its spirit and scope. As such, the nominal half-inch (½") square receiver or upper socket aperture 48 configured for removable receipt of the corresponding nominal half-inch (½") square driver (not shown) of a ratcheting wrench R or of any extension E are to be understood as being merely illustrative and non-limiting, such that a variety of other tools and related connections to the self-flexing socket tool 30 in terms of size or shape of the engagement features, including but not limited to square, may be employed. As shown, the ratchet R may have a proximal handle R1 and a distal driver assembly R2 to which the socket tool 30 may be connected directly or an extension E may be connected in between as engaging the proximal end E1 of the extension E with the drive (not shown) of the driver assembly R2 and the opposite distal end E2 with the socket tool 30, and the upper socket aperture 48 of the upper socket linkage 40 specifically. Again, those skilled in the art will appreciate that a variety of other tools used alone or in combination may be employed in conjunction with a self-flexing socket tool 30 according to aspects of the present invention without departing from its spirit and scope. Regardless, it will be appreciated that some kind of tool may be connected to the self-flexing socket 30 so as to "drive" it or to apply a rotational force or torque to it, such torque being applied substantially along the axis of the upper socket linkage 40 as through engagement with and along the centerline of the upper socket aperture 48 (FIG. 1). It will be appreciated that as shown the socket tool 30 is in its "at rest" or un-flexed first configuration to which the spring member 100 biases it, corresponding to the views of FIGS. 1-3, whereby the centerline of the driver assembly R2, extension E, and upper socket aperture 48 are substantially aligned with the centerline of the lower socket aperture 68 (FIG. 1), and thus whatever nut or bolt is being driven or turned. The torque is thus transferred in a "straight-line" fashion from the driver assembly R2 as actuated by rotation of the handle R1 of the ratchet R to the lower socket aperture 68 as transmitted through the linkages 40, 60, 80 of the socket tool 30. Similarly, even where the socket tool 30 is to be flexed in use as shown in FIGS. 4 and 5, as by pivoting the upper and lower socket linkages 40, 60 relative to the intermediate connecting linkage 80 about the respective upper and lower pivots or cross-pins 86, 88, the rotational force or torque applied to the upper socket linkage 40 is transferred to the intermediate connecting linkage 80 through the engagement of the upper end 82 of the intermediate connecting linkage 80 between the distally-extending upper linkage connection tabs 46 as secured in place by the upper cross-pin 86 and from the intermediate connecting linkage 80 to the lower socket linkage 60 through engagement of the lower end 84 of the intermediate connecting linkage 80 between the proximally-extending lower linkage connection tabs 66 as secured in place by the lower cross-pin 88. Therefore, those skilled in the art will appreciate that through the configuration and arrangement of the linkages 40, 60, 80 as herein shown and described substantially all torque applied to the upper socket linkage 40 is transferred to the lower socket linkage 60, whether the tool 30 is un-flexed or flexed—thus there is "no torque lost," more about which is said below in connection with use of the self-flexing socket tool 30. It will once again be appreciated that selective flexure of the socket tool 30 is possible and accomplished by simply pushing on the proximal tab 104 formed on the body 102 of the spring member 100 as herein described. It will be further appreciated that as shown schematically the tab 104 is clear of the distal end E2 of the extension E so as to be selectively actuated without interference, which may be accomplished by grasping the extension E with the fingers of a hand and pushing on the tab 104 with the thumb to thereby articulate the free lower socket linkage 60 and position it at a different angle from or "off-axis" to the upper socket linkage 40 as desired in use. Once the tab 104 is released, the spring member 100 would urge the linkages 40, 60, 80 of the socket tool 30 back to their biased or "at rest" in-line configuration as shown in FIGS. 1-3 and 6. Those skilled in the art will appreciate that such tool 30 is "self-flexing" in that upon actuation the tool itself articulates or shifts to various flexed positions simply due to the mechanical or kinematic arrangement of the tool 30, it thus being able to flex itself.

Figure 7:
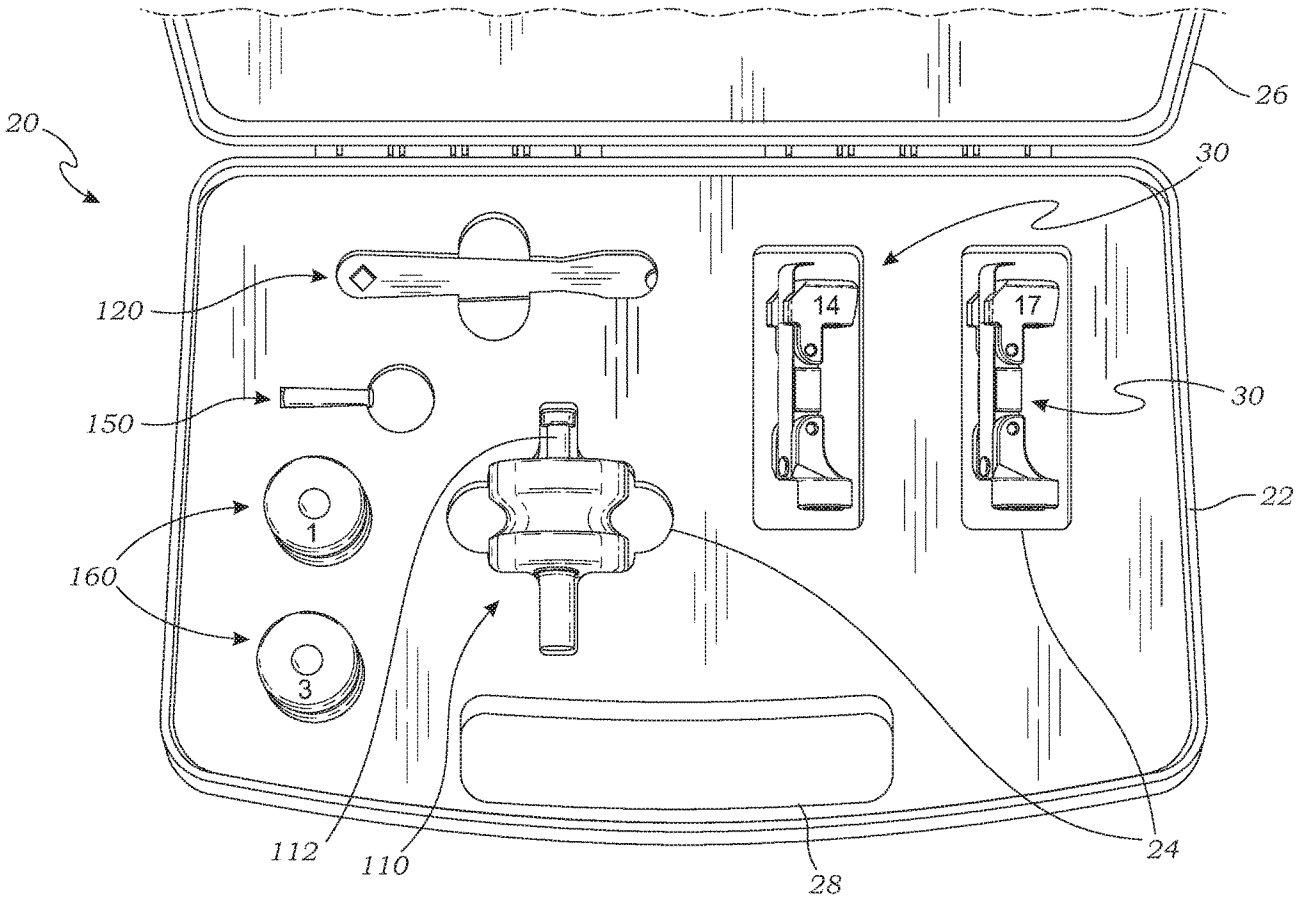
FIG. 7 is a top perspective view of an exemplary tool kit including the self-flexing socket tool of FIGS. 1-6, shown in reduced scale, in accordance with at least one embodiment.

Referring next briefly to FIG. 7, there is shown a top perspective view of an exemplary tool kit 20 including the self-flexing socket tool 30 of FIGS. 1-6 along with a variety of other tools, more about each of which is said below in connection with FIGS. 8-11. Generally concerning such an exemplary direct fuel injection repair kit 20 according to aspects of the present invention, as shown, the kit 20 comprises, in no particular order other than generally in the order in which they might be used in the exemplary repair: 14 mm and 17 mm self-flexing socket tools 30; an injector puller 110; an injector seal removal tool 120; a mandrel 150; and compression tools 160 in three sizes. Those skilled in the art will appreciate that any such kinds, number and combinations of tools and components are possible according to aspects of the present invention, such that the exemplary direct fuel injection repair kit 20 as shown and described is to be understood as merely illustrative and non-limiting—additional tools or components may be included or some tools or components shown may not be included. For example, additional components in the kit might include protective caps for the nominal 12 mm and 14 mm fuel line ports. The exemplary kit 20 further comprises a case 22 having various recesses, pockets, or cut-outs 24 sized and configured to selectively house the tools included, as above-described for the exemplary kit 20, a lid 26 pivotally connected to the case 22, and a handle 28 formed within the case 22 and as appropriate the lid 26. Those skilled in the art will appreciate that a virtually infinite variety of such kits 20 now known or later developed may be employed in conveniently containing the desired tools, such that that shown and described is to be understood as merely illustrative and non-limiting.

Figure 8:
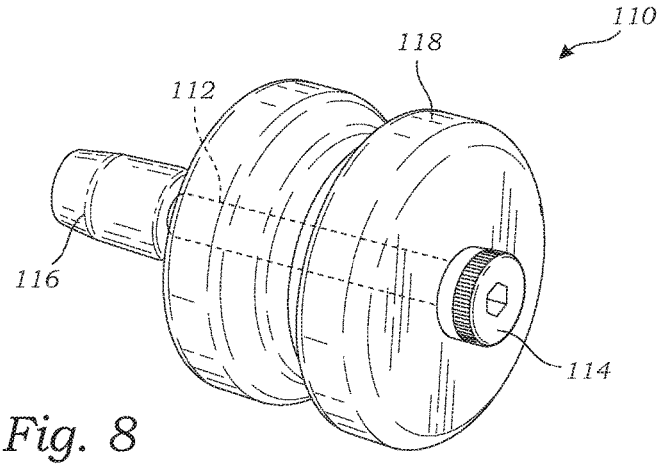
FIG. 8 is an enlarged side perspective view of an exemplary injector puller thereof, in accordance with at least one embodiment.
Figure 12:
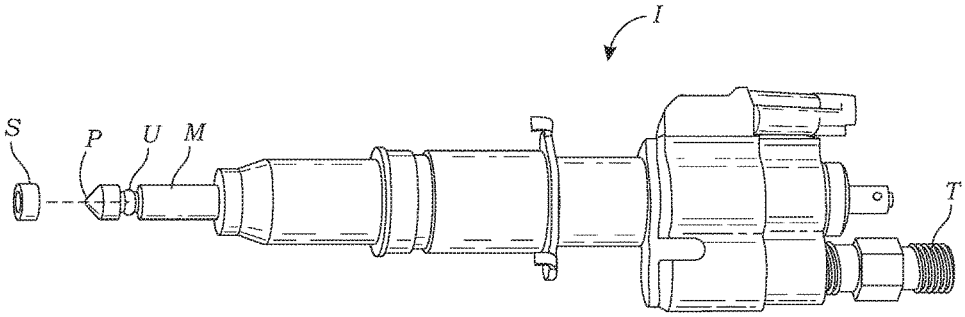
Prior Art Fig. 12
FIG. 12 is a reduced scale exploded side perspective view of an exemplary prior art injector with injector seal.

Turning briefly to FIG. 8, there is shown an enlarged side perspective view of an exemplary injector puller 110 according to aspects of the present invention. The injector puller 110 comprises a central bolt 112 (FIG. 7) and a puller body 118 slidably installed therealong. The bolt 112 has a proximal head 114 having a hex hole and knurled outer surface so that it can be turned by hand or by an appropriate Allen wrench or the like and an opposite distal coupler 116 threadably engaged on the bolt 112 and itself having an internal or female thread configured to engage the external or male thread T of the injector I (FIG. 12). With the bolt 112 and mating coupler 116 thus threaded onto the threaded connector T of an injector I installed within an engine (not shown), the puller body 118 may be slid axially up or away from the injector I in somewhat rapid movements so as to impact the back of the head 114 and gradually work the injector I free much like the operation of a slide hammer. Conveniently, where space allows, more travel of the puller body 118 is possible by temporarily removing the coupler 116 from the bolt 112 and passing the bolt 112 back through the puller body 118 from the opposite end, which is counterbored to a partial depth at a diameter larger than that of the head 114 of the bolt 112, whereby the puller body 118 can then travel further or higher on the bolt when the coupler 116 is reinstalled thereon. The puller body 118 may be formed with one or more grooves or other surface features now known or later developed to facilitate grasping during use. Once more, those skilled in the art will appreciate that a variety of other configurations of the injector puller 110 are possible without departing from the spirit and scope of the invention.

Figure 9:
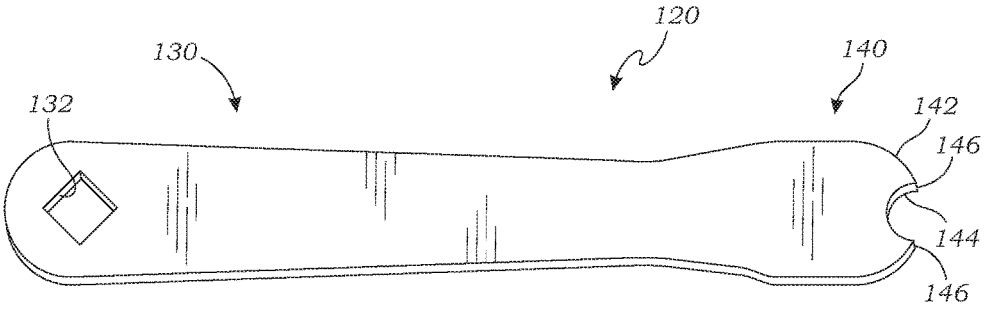
FIG. 9 is an enlarged side perspective view of an exemplary injector seal removal tool thereof, in accordance with at least one embodiment.

Referring next to FIG. 9, there is shown an enlarged side perspective view of an exemplary injector seal removal tool 120 according to aspects of the present invention that may also be included in the illustrated direct fuel injection repair kit 20 for removal of an existing injector seal S (FIG. 12) from the typical undercut U on the injector stem M proximal of the tip P) of a typical injector I (FIG. 12). As shown, the injector seal removal tool 120 generally comprises a proximal elongate handle portion 130 and a distal working portion 140. The removal tool 120 is shown as being formed of a single flat metal stock as through a stamping or die-cutting process, such that the handle and working portions 130, 140 are integral and the tool 120 is unitary, though it will be appreciated that other configurations and related methods of manufacture are possible without departing from the spirit and scope of the invention, including but not limited to machining or injection molding. The handle portion 130 is shown as having a through-hole 132 in its proximal end which may be formed as a key way or square drive for optionally engaging a nut of appropriate size. Or the through-hole 132 may simply be used to hang the removal tool 120 in a work area or the like. At the opposite, distal end of the removal tool 120 there is again a working portion 140. The working portion 140 is uniquely formed as having an angled tip 142 and a substantially central or axially aligned curved cut-out 144 that intersects the angled tip 142, with such intersections or corners defining relatively sharp leading edges 146 on opposite sides of the cut-out 144. It will be appreciated that by forming the cut-out 144 with a nominal diameter or width thereacross, substantially perpendicular to the axis of the removal tool 120, that is substantially equivalent to the nominal inside diameter of the injector seal S or to the nominal outside diameter of the groove or undercut U on the injector stem M in which the injector seal S is seated, the resulting functionality or capability of the tool 120 is such that by being aligned substantially directly over the injector seal S to be removed as well as the associated undercut U in a plane substantially parallel to that of the seal S and undercut U and perpendicular to that of the injector I lengthwise, axial pressure then applied to the removal tool 120 causes the leading edges 146 to slice through and ultimately bisect the injector seal S as the curved cut-out 144 straddles the injector undercut U and the upper half of the bisected injector seal S. Notably, the injector seal removal tool 120 at no point makes contact with the injector stem M, particularly not the injector tip P.

Figure 10:
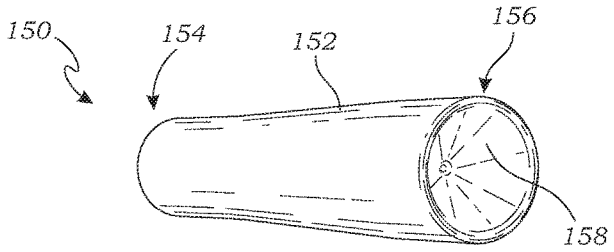
FIG. 10 is an enlarged end perspective view of an exemplary mandrel thereof, in accordance with at least one embodiment.

Turning briefly to FIG. 10, there is shown an enlarged end perspective view of an exemplary mandrel 150 according to aspects of the present invention as may also be included in the illustrated direct fuel injection repair kit 20 for use in installing an injector seal S onto the injector stem M proximal of the tip P (FIG. 12). The mandrel 150 is formed having a tapered body 152 from its proximal end 154 to its distal end 156, from small to large diameter. That is, the diameter of the mandrel body 152 is smaller at its proximal end 154 and gets larger to its distal end 156. In the exemplary embodiment, the diameter at the proximal end 154 is smaller than the nominal inside diameter of the injector seal S so that the seal S can easily be started onto the mandrel 150 from its proximal end 154 during use, and the diameter of the mandrel 150 at its distal end 156 is substantially equivalent to the diameter of the injector stem M to facilitate sliding the seal S off of the mandrel 150 and onto the stem M again during use. Notably, at the distal end 156 of the mandrel 150 there is formed a distally-opening conical bore 158 configured to straddle but not contact the injector tip P (FIG. 12) when the mandrel 150 is butted up to and aligned with the injector stem M, again, to transfer the seal S from the mandrel onto the stem M and into the undercut U Because of the conical bore 158 it is assured that the injector tip P will not be contacted even as the new seal S is installed.

Figure 11A:
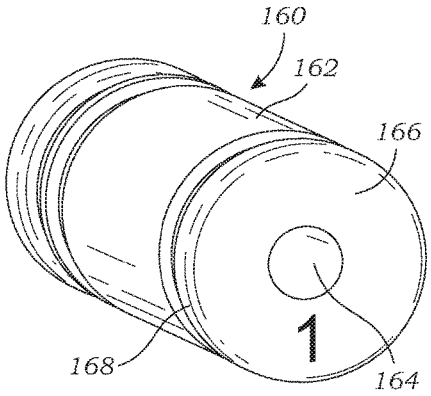
FIGS. 11A-11C are enlarged end perspective views of exemplary compression tools thereof in three sizes, in accordance with at least one embodiment.
Figure 11B:
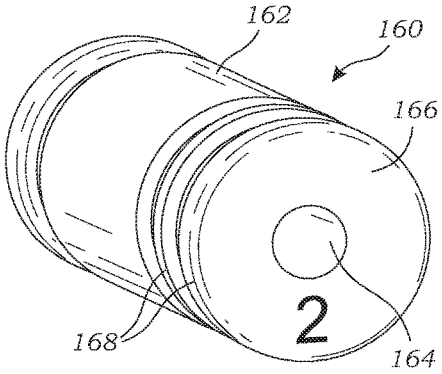
Figure 11C:
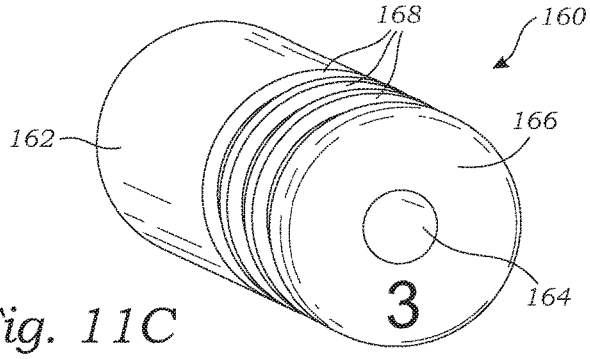

Finally, referring briefly to FIGS. 11A-11C, there are shown enlarged end perspective views of exemplary compression tools 160 according to aspects of the present invention as may also be included in the illustrated direct fuel injection repair kit 20 for use in compressing or squeezing the injector seal S within the typical undercut U on the injector stem M proximal of the tip P (FIG. 12). Essentially, each compression tool 160 is formed having a body 162 with a machined bore 164 therein designed to be pushed over the injector stem M so as to progressively shrink or compress the new injector seal S down to seat better or more fully within the undercut U prior to reinstallation of the injector I in the engine's cylinder head (not shown). In the exemplary embodiment, two of the compression tools 160 are built into one, with the nominal "1" compression tool 160 formed in one end of the tool, or having the first or largest diameter bore formed in the end of the tool 160 marked "1" and the nominal "2" compression tool 160 simply being formed in the opposite end of the same tool, the "2" end having a slightly smaller diameter bore than the "1" end. This is why in the exemplary kit 20 shown in FIG. 7 there appear to be only "1" and "3" compression tools 160, with the "2" compression tool 160 simply being the opposite end of the "1" compression tool 160 that is face-down in the tool case 22. The separate nominal "3" compression tool 160 has a still smaller diameter bore than the "2" tool (or end). As such, as each compression tool 160 (or end thereof) is sequentially pushed over the injector stem M and stops against the shoulder proximal of the stem M, and thus is positioned over and rotated on the seal S, the seal S is thus squeezed down or compressed within the undercut U. In the illustrated embodiment, the serial compression of the seal S accomplished by the three compression tools 160 illustrated is sufficient to shrink the injector seal S and thus complete the seal replacement and have the injector I ready for reinstallation. In practice, the nominal "3" or whatever compression tool 160 is last or smallest may be left on the injector I until it is ready to be reinstalled, else the seal S may expand and the compression steps need to be repeated. In the exemplary embodiment, the compression tool 160, or the "1", "2" or "3" end thereof, may be engraved or marked on the face 166 of the tool 160 where the bore 164 is machined. Instead or in addition, identifying grooves 168 may be formed in the compression tool body 162, with the number of grooves signifying the tool "number". Those skilled in the art will appreciate that a variety of such compression tools 160 and number and configuration thereof are possible according to aspects of the present invention without departing from its spirit and scope.

In use, the self-flexing socket tool 30, in one or more sizes, and/or the injector seal removal tool 120 and/or associated direct fuel injection repair kit 20 of the present invention enable and effectively render more efficient the successful removal and replacement of individual injector seals in an engine such as the BMW N63 engine without removal of the engine or surrounding components. At a very high level, in the exemplary context of removal and reinstallation of automotive fuel injectors, such as when the injector seals are to be replaced, such may advantageously be accomplished, in part, by accessing and selectively tightening or loosening the typical 14 mm injector line nuts or connections and 17 mm high pressure fuel line nut or connection even in typically tight or hard to reach spaces, particularly the lower connections at the high pressure injector rail or fuel rail, as by employing an appropriately sized self-flexing socket tool 30 according to aspects of the present invention. It will be appreciated that the flexing or curvature of the tool 30 enabled by its spring-biased, articulating design enables the tool 30 to bend "around corners" and effectively position the crow's foot lower socket aperture 68 on the fuel or high pressure line connector substantially aligned with the central axis thereof, which is often at an angle from vertical, while the opposite upper end of the tool 30, or the upper socket linkage 40, may be oriented substantially vertically with the upper socket aperture 48 engaged in an otherwise conventional fashion by a ratchet R, self-locking socket extension E (FIG. 6) or the like so as to drive (tighten or loosen or turn clockwise or counter-clockwise) the upper socket linkage 40 and as a result the lower socket linkage 60 and thereby the connector or nut that is to be tightened or loosened. Those skilled in the art will appreciate that in this manner the self-flexing socket tool 30 substantially conforms to or hugs the engine block or valve cover (not shown) with relatively little stand-off, thereby enabling the tool 30 to be operably positioned in relatively tighter spaces and to orient the proximal driving end of the tool 30 (i.e., the upper socket linkage 40) substantially vertically or at whatever angle is desired while the distal driven end of the tool 30 (i.e., the lower socket linkage 60) may be at an angle so as to be aligned with a connector or nut such as at the lower high-pressure fuel rail connections (not shown). It will again be further appreciated that by directly mechanically coupling the upper and lower socket linkages 40, 60 via the pinned intermediate connecting linkage 80, the force or torque applied to the upper socket linkage 40 as through engagement of a ratchet tool R or extension E (FIG. 6) with the upper socket aperture 48 formed in the upper socket body 42 is transmitted along the connecting linkage 80 to the lower socket linkage 60 and thus applied to the connector or nut engaged by the lower socket aperture 68 of the crow's foot lower socket body 62. In applications such as injector installation, it will be appreciated that relatively precise torque control or transmission is important in doing the repair job correctly, rendering the self-flexing socket tool 30 further advantageous on this basis. For example, in one illustrative automotive context, the fuel line connections are to be tightened to an initial torque of 10 Nm and a final torque of 23 Nm while the high-pressure line connections are to be tightened to an initial torque of 10 Nm and a final torque of 30 Nm, which precision is made possible even employing a self-flexing socket tool 30 according to aspects of the present invention due to its unique mechanical and kinematic design. It will again be appreciated that while a particular industrial context is shown and described with particularly the lower crow's foot apertures nominally configured for engaging 14 mm and 17 mm nuts or connections the invention is not so limited. Moreover, the invention is not even limited to the automotive context, as it will be appreciated that a wide variety of other commercial contexts exist wherein a nut or connection that is to be tightened or loosened is difficult to access and is preferably driven along an axis at an angle to the axis of the nut or connection, which again is effectively enabled even without appreciable torque loss in the self-flexing socket tool according to aspects of the present invention. Therefore, any such self-flexing socket tool 30 may be sold alone or with other sizes and other tools and components in a kit, such as the illustrative direct fuel injection repair kit 20 shown and described herein as including other tools and accessories as well as described herein.

Aspects of the present specification may also be described as follows:

1. A self-flexing socket tool comprising: an upper socket linkage, an intermediate connecting linkage, and a lower socket linkage coupled substantially in series and having two pivot points therebetween; and a spring member fixedly coupled to the lower socket linkage and slidably coupled to the upper socket linkage, wherein the spring member biases the upper socket, intermediate connecting, and lower socket linkages into a substantially aligned first operable configuration, and further wherein the spring member may be selectively actuated to shift the upper socket, intermediate connecting, and lower socket linkages into a substantially curved second operable configuration.

2. The self-flexing socket tool of embodiment 1 wherein: the upper socket linkage comprises an upper socket body having at least one upper linkage connection tab pivotally engaged with an upper end of the intermediate connecting linkage; and the lower socket linkage comprises a lower socket body having at least one lower linkage connection tab pivotally engaged with a lower end of the intermediate connecting linkage.

3. The self-flexing socket tool of embodiment 2 wherein the two pivot points comprise: an upper cross-pin inserted through the at least one upper linkage connection tab and the upper end of the intermediate connecting linkage; and a lower cross-pin inserted through the at least one lower linkage connection tab and the lower end of the intermediate connecting linkage.

4. The self-flexing socket tool of embodiment 2 wherein: the at least one upper linkage connection tab is offset from a centerline of the upper socket body; and the at least one lower linkage connection tab is offset from a centerline of the lower socket body; whereby a centerline of the intermediate connecting linkage is offset from the centerlines of the upper and lower socket bodies.

5. The self-flexing socket tool of any of embodiments 2-4 wherein the upper socket body comprises: an upper proximal surface; and an upper socket aperture formed in the upper socket body so as to be in communication with the upper proximal surface, the upper socket aperture being offset from the at least one upper linkage connection tab.

6. The self-flexing socket tool of embodiment 5 wherein the upper socket aperture comprises inner walls having indents formed therein.

7. The self-flexing socket tool of embodiment 5 wherein the lower socket body comprises a lower socket aperture substantially in-line with the upper socket aperture when the self-flexing socket tool is in the first operable configuration with the upper socket, intermediate connecting, and lower socket linkages substantially aligned.

8. The self-flexing socket tool of embodiment 7 wherein an opening is formed in the lower socket body so as to intersect the lower socket aperture.

9. The self-flexing socket tool of any of embodiments 1-8 wherein the spring member comprises a substantially flat, flexible, elongate spring body.

10. The self-flexing socket tool of embodiment 9 wherein the spring body is fixed to the lower socket linkage by a mounting post affixed to the lower socket body.

11. The self-flexing socket tool of embodiment 9 or embodiment 10 wherein the spring body is slidably engaged with the upper socket linkage by passing the spring body through a slotted channel formed on the upper socket body.

12. The self-flexing socket tool of embodiment 11 wherein the slotted channel is offset from and substantially parallel to the at least one upper linkage connection tab.

13. The self-flexing socket tool of any of embodiments 9-12 wherein the spring body is formed having a proximal tab for facilitating selective actuation of the spring member to shift the upper socket, intermediate connecting, and lower socket linkages into the substantially curved second operable configuration.

14. An injector puller comprising: a central bolt having a proximal head and an opposite distal coupler threadably engaged on the central bolt, the coupler configured to selectively threadably engage an injector; and a puller body slidably installed along the central bolt, the proximal head of the central bolt configured to be selectively impacted by the puller body.

15. The injector puller of embodiment 14 wherein the central bolt may be reversed as by temporarily disengaging the coupler and inserting the central bolt within the puller body from an opposite end and then reengaging the coupler on the central bolt.

16. The injector puller of embodiment 14 or embodiment 15 wherein the puller body is counter-bored at one end to a diameter larger than that of the proximal head of the central bolt.

17. An injector seal removal tool comprising: a handle portion; and a working portion connected to the handle portion, the working portion comprising an angled tip terminating distally in a curved cut-out so as to form opposite leading edges at the intersections of the angled tip and the curved cut-out.

18. The injector seal removal tool of embodiment 17 wherein the width of the curved cut-out and thus the distance between opposite leading edges is substantially equivalent to the diameter of an undercut formed on an injector stem of an injector wherein is seated an injector seal that is to be removed by the injector seal removal tool during use.

19. A mandrel comprising a tapered body having a proximal end and an opposite distal end, the tapered body being tapered from a smaller diameter at the proximal end to a larger diameter at the distal end, the diameter of the tapered body at the proximal end approximating the diameter of an undercut formed on an injector stem of an injector wherein is seated an injector seal that is to be installed with the assistance of the mandrel, and the diameter of the tapered body at the distal end approximating the diameter of the injector stem to facilitate transitioning an injector seal from the mandrel to the injector stem during use.

20. The mandrel of embodiment 19 having a conical bore formed at the distal end configured to straddle an injector tip formed on the injector stem of the injector during use of the mandrel there against.

21. A compression tool comprising a compression body having a lengthwise compression bore formed therein, the compression bore being configured to apply a radially-inward force on an injector seal when the compression body is temporarily installed on an injector stem of an injector during use.

22. The compression tool of embodiment 21 wherein the compression body is formed with a compression tool face that is selectively marked to indicate a nominal size of the compression tool.

23. The compression tool of embodiment 21 or embodiment 22 wherein the compression body is formed having one or more circumferential grooves to indicate a nominal size of the compression tool.

24. The compression tool of any of embodiments 21-23 wherein two nominal sizes are formed therein at opposite ends of the compression bore.

25. A method of employing a self-flexing socket tool as defined in any one of embodiments 1-13, the method comprising the steps of: engaging the self-flexing socket tool with a ratcheting tool; and actuating the spring member of the self-flexing socket tool to shift the upper socket, intermediate connecting, and lower socket linkages into the substantially curved second operable configuration.

26. The method of embodiment 25 wherein the step of engaging the self-flexing socket tool with a ratcheting tool comprises inserting a driver assembly of the ratcheting tool into a proximal end of an extension and inserting a distal end of the extension into an upper socket aperture formed in an upper socket body of the upper socket linkage.

27. The method of embodiment 25 wherein the step of engaging the self-flexing socket tool with a ratcheting tool comprises inserting a driver assembly of the ratcheting tool into an upper socket aperture formed in an upper socket body of the upper socket linkage.

28. The method of any of embodiments 25-27 wherein the step of actuating the spring member of the self-flexing socket tool comprises pushing distally on a proximal tab formed on a spring body of the spring member to cause the spring member to push against the lower socket linkage as the spring member slides within a slotted channel formed on the upper socket body of the upper socket linkage.

29. The method of any of embodiments 25-28 further comprising the steps of: positioning a lower socket aperture formed in a lower socket body of the lower socket linkage on a nut; and rotating the ratcheting tool to rotate the coupled upper socket, intermediate connecting, and lower socket linkages so as to rotate the nut without any torque lost.

30. A method of employing an injector puller as defined in any one of embodiments 14-16, the method comprising the steps of: threadably engaging the coupler of the central bolt with a threaded connector of an injector; and repeatedly slidably impacting the proximal head of the central bolt with the puller body so as to dislodge the injector.

31. The method of embodiment 30 comprising the further steps of: disengaging the coupler and inserting the central bolt within the puller body from an opposite end; and reengaging the coupler on the central bolt so as to reverse the central bolt within the puller body and thereby provide for relatively greater travel of the puller body along the central bolt.

32. A method of employing an injector seal removal tool as defined in embodiment 17 or embodiment 18, the method comprising the steps of: positioning the curved cut-out formed in the working portion of the injector seal removal tool directly over an injector seal installed in an undercut of an injector stem of an injector; aligning the handle portion of the injector seal removal tool such that it is substantially perpendicular to the injector stem; and pushing axially distally on the injector seal removal tool as by grasping the handle portion to shift the working portion distally and cause the opposite leading edges formed at the intersections of the angled tip and the curved cut-out of the working portion to sever the injector seal as the curved cut-put portion straddles the undercut of the injector stem.

33. A method of employing a mandrel as defined in embodiment 19 or embodiment 20, the method comprising the steps of: sliding an injector seal axially onto the proximal end of the tapered body of the mandrel; abutting the distal end of the tapered body of the mandrel on the injector stem such that a conical bore formed at the distal end straddles an injector tip formed on the injector stem of the injector; and sliding the injector seal distally along the tapered body of the mandrel and onto the injector stem and therealong into the undercut.

34. A method of employing a compression tool as defined in any one of embodiments 21-24, the method comprising the step of slidably installing the compression tool onto the injector as by pushing the compression bore over the injector stem so as to enclose the injector seal and apply a radially-inward force on the injector seal.

35. The method of embodiment 34 comprising the further steps of: removing the compression tool from the injector stem; flipping the compression tool relative to the injector stem; and slidably reinstalling the compression tool onto the injector as by pushing the compression bore over the injector stem now from the opposite end so as to again enclose the injector seal and apply a relatively greater radially-inward force on the injector seal due to the relatively smaller diameter of the compression bore at the opposite end.

36. The method of embodiment 34 or embodiment 35 comprising the further step of leaving the compression tool installed on the injector stem until time to reinstall the injector.

37. The method of any of embodiments 34-36 comprising the further step of selecting a plurality of compression tools with ascending nominal sizes and gradually descending compression bore diameters so as to progressively compress the injector seal as the plurality of compression tools are employed sequentially.

38. A kit comprising a self-flexing socket tool as defined in any one of embodiments 1-13.

39. A kit comprising an injector puller as defined in any one of embodiments 14-16.

40. A kit comprising an injector seal removal tool as defined in embodiment 17 or embodiment 18.

41. A kit comprising a mandrel as defined in embodiment 19 or embodiment 20.

42. A kit comprising a compression tool as defined in any one of embodiments 21-24.

43. A kit comprising two or more tools selected from the group comprising a self-flexing socket tool as defined in any one of embodiments 1-13, an injector puller as defined in any one of embodiments 14-16, an injector seal removal tool as defined in embodiment 17 or embodiment 18, a mandrel as defined in embodiment 19 or embodiment 20, and a compression tool as defined in any one of embodiments 21-24.

44. The kit of any of embodiments 38-43 further comprising: a case formed with cut-outs for housing one or more of the self-flexing socket tool, the injector puller, the injector seal removal tool, the mandrel, and the compression tool; and instructional material.

45. The kit of embodiment 44 further comprising a lid and a handle incorporated with the case.

46. The kit of embodiment 44 or embodiment 45 wherein the instructional material provides instructions on how to perform the method as defined in any one of embodiments 25-37.

47. Use of a self-flexing socket tool as defined in any one of embodiments 1-13 to transmit a torque applied to the upper socket linkage thereof to the opposite lower socket linkage thereof with substantially no torque lost.

48. The use of embodiment 47 wherein the use comprises a method as defined in any one of embodiments 25-29.

49. Use of an injector puller as defined in any one of embodiments 14-16 to remove an injector from an engine.

50. The use of embodiment 49 wherein the use comprises a method as defined in embodiment 30 or embodiment 31.

51. Use of an injector seal removal tool as defined in embodiment 17 or embodiment 18 to remove an injector seal from an injector stem.

52. The use of embodiment 51 wherein the use comprises a method as defined in embodiment 32.

53. Use of a mandrel as defined in embodiment 19 or embodiment 20 to slide an injector seal onto an injector stem.

54. The use of embodiment 53 wherein the use comprises a method as defined in embodiment 33.

55. Use of a compression tool as defined in any one of embodiments 21-24 to compress an injector seal installed in an undercut of an injector stem.

56. The use of embodiment 55 wherein the use comprises a method as defined in any one of embodiments 34-37.

In closing, regarding the exemplary embodiments of the present invention as shown and described herein, it will be appreciated that self-flexing socket tools, individually and as included in a tool kit, are disclosed and configured for loosening or tightening hard to reach nuts, such as while replacing fuel injectors in an engine. Because the principles of the invention may be practiced in a number of configurations beyond those shown and described and a number of contexts, it is to be understood that the invention is not in any way limited by the exemplary embodiments, but is able to take numerous forms without departing from the spirit and scope of the invention. It will also be appreciated by those skilled in the art that the present invention is not limited to the particular geometries or any materials of construction disclosed, but may instead entail other functionally comparable structures or materials, now known or later developed, without departing from the spirit and scope of the invention. Therefore, it should be understood that the disclosed subject matter is in no way limited to a particular apparatus, methodology, configuration, size, shape, material of construction, protocol, etc., described herein or otherwise, but may include any such technology now known or later developed without departing from the spirit and scope of the specification. That is, it will be appreciated that any appropriate material and method of construction and assembly now known or later developed in forming the exemplary tools or any components thereof may be employed without departing from the spirit and scope of the invention. As such, various modifications or changes to or alternative configurations of the disclosed subject matter can be made in accordance with the teachings herein without departing from the spirit and scope of the present specification. Lastly, the terminology used herein is for the purpose of describing particular embodiments only, and is not intended to limit the scope of the present invention. Accordingly, the present invention is not limited to that precisely as shown and described. It should also be appreciated that none of the figures, images, drawings, or photos are or are to be taken to scale in terms of absolute size, relative size or proportion, or otherwise.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A self-flexing socket tool comprising:

an upper socket linkage, an intermediate connecting linkage, and a lower socket linkage coupled substantially in series and having two pivot points therebetween, the upper socket linkage comprising an upper socket body having at least one upper linkage connection tab pivotally engaged with an upper end of the intermediate connecting linkage, and the lower socket linkage comprising a lower socket body having at least one lower linkage connection tab pivotally engaged with a lower end of the intermediate connecting linkage; and a spring member fixedly coupled to the lower socket linkage and slidably coupled to the upper socket linkage by passing the spring member through a slotted channel formed externally on the upper socket linkage offset from and substantially parallel to the at least one upper linkage connection tab, wherein the spring member biases the upper socket, intermediate connecting, and lower socket linkages into a substantially aligned first operable configuration, and further wherein the spring member may be selectively actuated to shift the upper socket, intermediate connecting, and lower socket linkages into a substantially curved second operable configuration.

2. The self-flexing socket tool of claim 1 wherein the two pivot points comprise:

an upper cross-pin inserted through the at least one upper linkage connection tab and the upper end of the intermediate connecting linkage; and a lower cross-pin inserted through the at least one lower linkage connection tab and the lower end of the intermediate connecting linkage.

3. The self-flexing socket tool of claim 1 wherein:

the at least one upper linkage connection tab is offset from a centerline of the upper socket body; and the at least one lower linkage connection tab is offset from a centerline of the lower socket body;

whereby a centerline of the intermediate connecting linkage is offset from the centerlines of the upper and lower socket bodies.

4. The self-flexing socket tool of claim 3 wherein the upper socket body comprises:

an upper proximal surface; and an upper socket aperture formed in the upper socket body so as to be in communication with the upper proximal surface, the upper socket aperture being offset from the at least one upper linkage connection tab.

5. The self-flexing socket tool of claim 4 wherein the upper socket aperture comprises inner walls having indents formed therein.

6. The self-flexing socket tool of claim 4 wherein the lower socket body comprises a lower socket aperture substantially in-line with the upper socket aperture when the self-flexing socket tool is in the first operable configuration with the upper socket, intermediate connecting, and lower socket linkages substantially aligned.

7. The self-flexing socket tool of claim 6 wherein an opening is formed in the lower socket body so as to intersect the lower socket aperture.

8. The self-flexing socket tool of claim 1 wherein the spring member comprises a substantially flat, flexible, elongate spring body.

9. The self-flexing socket tool of claim 8 wherein the spring body is fixed to the lower socket linkage by a mounting post affixed to the lower socket body.

10. The self-flexing socket tool of claim 8 wherein the spring body is formed having a proximal tab for facilitating selective actuation of the spring member to shift the upper socket, intermediate connecting, and lower socket linkages into the substantially curved second operable configuration.

11. A self-flexing socket tool comprising:

an upper socket linkage, an intermediate connecting linkage, and a lower socket linkage coupled substantially in series and having two pivot points therebetween, the upper socket linkage comprising an upper socket body having at least one upper linkage connection tab pivotally engaged with an upper end of the intermediate connecting linkage and further having an upper socket aperture and an offset slotted channel formed in the upper socket body, and the lower socket linkage comprising a lower socket body having at least one lower linkage connection tab pivotally engaged with a lower end of the intermediate connecting linkage and further having a lower socket aperture and a mounting post affixed to the lower socket body; and a spring member comprising a substantially flat, flexible, elongate spring body terminating proximally in a proximal tab, the spring member fixedly coupled to the lower socket linkage through engagement of the spring body with the mounting post and slidably coupled to the upper socket linkage through engagement of the spring body with the slotted channel, wherein the spring member biases the upper socket, intermediate connecting, and lower socket linkages into a substantially aligned first operable configuration, and further wherein the spring member may be selectively actuated as by pushing the proximal tab distally to shift the upper socket, intermediate connecting, and lower socket linkages into a substantially curved second operable configuration.

12. A self-flexing socket tool comprising:

an upper socket linkage, an intermediate connecting linkage, and a lower socket linkage coupled substantially in series and having two pivot points therebetween, the upper socket linkage comprising an upper socket body having at least one upper linkage connection tab pivotally engaged with an upper end of the intermediate connecting linkage, and the lower socket linkage comprising a lower socket body having at least one lower linkage connection tab pivotally engaged with a lower end of the intermediate connecting linkage; and a spring member fixedly coupled to the lower socket linkage and slidably coupled to the upper socket linkage, the spring member comprising a substantially flat, flexible, elongate spring body formed having a proximal tab for facilitating selective actuation of the spring member to shift the upper socket, intermediate connecting, and lower socket linkages from the spring member-biased substantially aligned first operable configuration of the upper socket, intermediate connecting, and lower socket linkages into a substantially curved second operable configuration of the upper socket, intermediate connecting, and lower socket linkages.

13. A fuel injector tool kit comprising:

a self-flexing socket tool comprising:

an upper socket linkage, an intermediate connecting linkage, and a lower socket linkage coupled substantially in series and having two pivot points therebetween, the upper socket linkage comprising an upper socket body having at least one upper linkage connection tab pivotally engaged with an upper end of the intermediate connecting linkage, and the lower socket linkage comprising a lower socket body having at least one lower linkage connection tab pivotally engaged with a lower end of the intermediate connecting linkage; and a spring member fixedly coupled to the lower socket linkage and slidably coupled to the upper socket linkage by passing the spring member through a slotted channel formed externally on the upper socket linkage offset from and substantially parallel to the at least one upper linkage connection tab, wherein the spring member biases the upper socket, intermediate connecting, and lower socket linkages into a substantially aligned first operable configuration, and further wherein the spring member may be selectively actuated to shift the upper socket, intermediate connecting, and lower socket linkages into a substantially curved second operable configuration; and an injector seal removal tool comprising:

a handle portion; and a working portion connected to the handle portion, the working portion comprising an angled tip terminating distally in a curved cut-out so as to form opposite leading edges at the intersections of the angled tip and the curved cut-out.

14. The kit of claim 13 wherein the width of the curved cut-out and thus the distance between opposite leading edges is substantially equivalent to the diameter of an undercut formed on an injector stem of an injector wherein is seated an injector seal that is to be removed by the injector seal removal tool during use.

* * * * *